US009728836B2

(12) United States Patent
Feng et al.

(10) Patent No.: US 9,728,836 B2
(45) Date of Patent: Aug. 8, 2017

(54) ELECTRONIC DEVICE INCLUDING MAIN BODY, MOVABLE PORTION AND CONNECTOR

(71) Applicants: Beijing Lenovo Software Ltd., Beijing (CN); Lenovo (Beijing) Limited, Beijing (CN)

(72) Inventors: Yiping Feng, Beijing (CN); Jun Ma, Beijing (CN); Shuangqi Cen, Beijing (CN)

(73) Assignees: Beijing Lenovo Software Ltd., Beijing (CN); Lenovo (Beijing) Limited, Beijing (CN)

( * ) Notice: Subject to any disclaimer, the term of this patent is extended or adjusted under 35 U.S.C. 154(b) by 0 days.

(21) Appl. No.: 14/753,412

(22) Filed: Jun. 29, 2015

(65) Prior Publication Data

US 2016/0254585 A1 Sep. 1, 2016

(30) Foreign Application Priority Data

Feb. 28, 2015 (CN) ..... 2015 1 0091705

(51) Int. Cl.
*H01Q 21/28* (2006.01)
*H01Q 1/12* (2006.01)
*H01Q 1/24* (2006.01)

(52) U.S. Cl.
CPC ..... *H01Q 1/1257* (2013.01); *H01Q 1/243* (2013.01); *H01Q 21/28* (2013.01)

(58) Field of Classification Search
CPC ..... H01Q 1/12; H01Q 1/36; H01Q 1/1212; H01Q 1/1257; H01Q 1/243; H01Q 21/28
USPC ..... 343/757, 878, 806
See application file for complete search history.

(56) References Cited

U.S. PATENT DOCUMENTS 6,400,931 B1 * 6/2002 Inkinen ..... H01Q 1/084 455/128
7,530,823 B1 * 5/2009 Thornton ..... H01Q 1/2275 439/131
2001/0044320 A1 11/2001 Ono et al.
2016/0202353 A1 * 7/2016 Saegusa ..... G01S 13/58 342/113

FOREIGN PATENT DOCUMENTS

CA 203747027 * 7/2014
CA 105100451 * 11/2015
CN 1668046 A 9/2005
(Continued)

OTHER PUBLICATIONS

"German Application Serial No. 102015110451.2, Office Action mailed Mar. 8, 2016", w/ English Translaiton, 8 pgs.
(Continued)

*Primary Examiner* — Lam T Mai
(74) *Attorney, Agent, or Firm* — Schwegman Lundberg & Woessner, P.A.

(57) ABSTRACT

An electronic device includes a main body, a movable portion, and a connector. A positional relationship between the main body and the movable portion is changeable via the connector. The main body includes a first surface having a display unit, the movable portion includes a second surface having a long side adaptive to a short side of the first surface, the movable portion has a first communication antenna unit.

10 Claims, 4 Drawing Sheets

(56) References Cited

FOREIGN PATENT DOCUMENTS

| | | | |
|---|---|---|---|
| CN | 1937422 | A | 3/2007 |
| CN | 101036374 | A | 9/2007 |
| CN | 2009260625 | A | 11/2009 |
| CN | 102007641 | A | 4/2011 |
| CN | 102324948 | A | 1/2012 |
| DE | 19958119 | A1 | 6/2001 |
| EP | 0603013 | A1 | 6/1994 |

OTHER PUBLICATIONS

"Chinese Application No. 201510091705.3, Office Action dated Jul. 18, 2016", w/ English Translation, (Jul. 18, 2016), 14 pgs.

* cited by examiner

ELECTRONIC DEVICE INCLUDING MAIN BODY, MOVABLE PORTION AND CONNECTOR

PRIORITY APPLICATIONS

This application claims the benefit under 35 U.S.C. 119 to Chinese Application No. 201510091705.3, filed on 28 Feb. 2015; which application is incorporated herein by reference in its entirety.

TECHNICAL FIELD

The present disclosure relates to the field of information processing technology, and in particular, to information processing of an electronic device.

BACKGROUND

With continuous development of science and technology, electronic devices have a variety of functions. However, communication function is still the most important one among the variety of functions, such as 4th Generation (4G) mobile communication function and the wireless communication function. Therefore, a user's experience in using the electronic device is dependent on a strength of a communication signal acquired by an electronic device. When the communication signal is received by the electronic device, the received signal may be poor due to the receiving direction, and thus the user needs to search for a direction in which the signal is strong as the electronic device moves, which causes a big trouble to the user and degrades the user experience.

SUMMARY

According to embodiments of the present disclosure, an electronic device is provided. The electronic device includes a main body, a movable portion, and a connector. A positional relationship between the main body and the movable portion is changeable via the connector. The main body includes a first surface having a display unit. The movable portion includes a second surface having a long side adaptive to a short side of the first surface. The movable portion has a first communication antenna unit.

In an embodiment, the long side of the second surface has a length equal to the short side of the first surface.

In an embodiment, when the movable portion and the main body are in a first positional relationship, both the first surface and the second surface are in a first plane. When the positional relationship between the movable portion and the main body is changed via the connector to a second positional relationship, a first end surface of the movable portion is parallel to a second end surface of the main body, and an overlapped area between the first end surface of the movable portion and the second end surface of the main body is smaller than a maximum overlapped area.

In an embodiment, the main body further includes a second communication antenna unit and a radio frequency unit. The first and second communication antenna units are electrically connected to the radio frequency unit. The second communication antenna unit and the first communication antenna unit are of a same type In an embodiment, the electronic device further includes a first processing unit arranged in the main body and configured to: determine whether a strength of a communication signal received by the radio frequency unit from the first communication antenna unit is lower than a first preset threshold value; and if the strength of the communication signal is lower than the first preset threshold value, generate first prompt information to prompt that the movable portion is to be adjusted such that the strength of the communication signal from the first communication antenna unit is not lower than the first preset threshold value. The radio frequency unit is configured to acquire the communication signal from the first communication antenna unit.

In an embodiment, the electronic device further includes a second processing unit arranged in the main body and configured to determine whether a strength of a communication signal received by the radio frequency unit from the first communication antenna unit is lower than a second preset threshold value; if the strength of the signal is lower than the second preset threshold value, generate a first control instruction for controlling a driving unit to drive the movable portion to rotate by a first predetermined angle via the connector, such that the strength of the communication signal from the first communication antenna unit is not lower than the second preset threshold value. The driving unit is configured to control the connector to rotate according to the instruction from the second processing unit.

In an embodiment, the first communication antenna unit includes N communication sub-units. The main body has a third processing unit including N processing sub-units corresponding to the N communication sub-units, where N is a positive integer greater than or equal to 1.

In an embodiment, the third processing unit is configured to: select a first communication sub-unit from the N communication sub-units; determine whether a strength of a signal from the first communication sub-unit is lower than a third preset threshold value; and if the strength of the signal is lower than the third preset threshold value, generate a second control instruction for controlling the driving unit to drive the movable portion to rotate by a second predetermined angle via the connector, such that the strength of the signal from the communication sub-unit is not lower than the third preset threshold value.

In an embodiment, the first communication antenna unit includes a first type of communication antenna unit and a second type of communication antenna unit, wherein the second type of communication antenna unit comprises M communication antenna sub-units, M being a positive integer greater than or equal to 1. The main body includes a radio frequency unit and a second communication antenna unit corresponding to the first type of communication antenna unit, a type of the first type of communication antenna unit is the same as that of the second communication antenna unit.

In an embodiment, the electronic device further includes a fourth processing unit configured to: acquire a type of a signal used by a first application; determine a corresponding communication unit according to the type of the signal; acquire a strength of the signal corresponding to the communication unit by using a detection unit; determine whether the strength of the signal corresponding to the communication unit is lower than a preset threshold value; and if the strength of the signal corresponding to the communication unit is lower than the preset threshold value, generate a third control instruction for controlling the driving unit to drive the movable portion to rotate by a third predetermined angle via the connector, such that the strength of the signal from the communication unit is not lower than the preset threshold value. The first application is an application running in foreground.

In an embodiment, the movable portion includes an image capture unit.

DETAILED DESCRIPTION

The present disclosure will be described in further detail below in conjunction with accompanying drawings and specific embodiments.

First Embodiment

Figure 1:
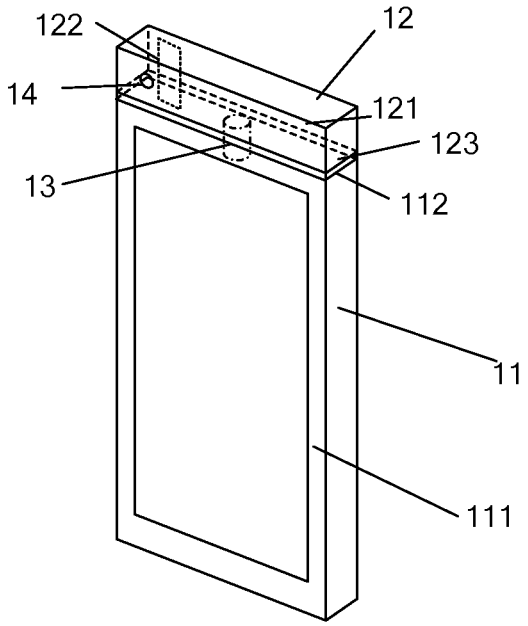
FIG. 1 is a structural diagram of an electronic device according to an embodiment of the present disclosure.

The embodiment of the present disclosure provides an electronic device. As shown in FIG. 1, the electronic device comprises a main body 11, a movable portion 12, and a connector 13.

A positional relationship between the main body 11 and the movable portion 12 is changeable via the connector 13.

The main body 11 comprises a first surface 111 having a display unit. The movable portion 12 comprises a second surface 121 having a long side adaptive to a short side of the first surface 111. Optionally, the long side of the second surface 121 has a length equal to the short side of the first surface 111. The movable portion 12 has a first communication antenna unit 122.

Here, the first communication antenna unit may be an antenna for communication, or may be a Global Positioning System (GPS) antenna, a Wireless Fidelity (WIFI) antenna or the like.

With the change in the positional relationship between the movable portion and the main body, a direction of the first communication antenna unit in the movable portion will be changed, so as to receive signals in different directions.

Thus, with the above solution, the electronic device has a main body and a movable portion whose a positional relationship can be changed. The movable portion of the electronic device also has a communication antenna unit. Thereby, with the change in the positional relationship between the movable portion and the main body, the direction of the first communication antenna unit in the movable portion can be changed, so that the strength of the signal received by the communication antenna unit can be adjusted, thereby improving the user experience.

Second Embodiment

The embodiment of the present disclosure provides an electronic device. As shown in FIG. 1, the electronic device comprises a main body 11, a movable portion 12, and a connector 13.

A positional relationship between the main body 11 and the movable portion 12 is changeable via the connector 13.

The main body 11 comprises a first surface 111 having a display unit. The movable portion 12 comprises a second surface 121 having a long side adaptive to a short side of the first surface 111. For example, the long side of the second surface 121 has a length same as the short side of the first surface 111. The movable portion 12 has a first communication antenna unit 122.

Here, the first communication antenna unit may be an antenna for communication, or may be a GPS antenna, a WIFI antenna or the like.

Further, as shown in FIG. 1, when the movable portion 12 and the main body 11 are in a first positional relationship, both the first surface 111 and the second surface 121 are in a first plane. In this case, a first end surface 123 of the movable portion 12 is parallel to a second end surface 112 of the main body 11, and an overlapped area between the first end surface 123 and the second end surface 112 reaches the maximum overlapped area. It can be seen from FIG. 1 that, when the main body and the movable portion are in the first positional relationship, the overlapped area therebetween is equal to an area of the first end surface or the second end surface. In addition, the first end surface 123 and the second end surface 112 may have the same size.

While FIG. 1 shows that a distance between the first end surface 123 and the second end surface 112 is relatively large, in practice the distance therebetween is sustainably equal to 0, and almost no gap can be seen from the first plane.

Figure 2:
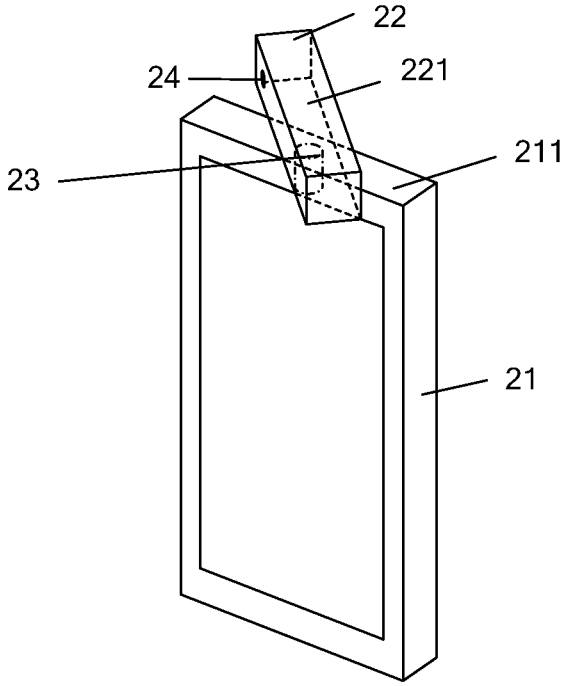
FIG. 2 is a diagram of relative horizontal rotation of a movable portion in an electronic device according to an embodiment of the present disclosure.

As shown in FIG. 2, when the positional relationship between the movable portion 22 and the main body 21 is changed via the connector 23 to a second positional relationship, a first end surface 221 of the movable portion 22 is parallel to a second end surface 211 of the main body 21, and an overlapped area between the first end surface 221 of the movable portion 22 and the second end surface 211 of the main body 21 is smaller than the maximum overlapped area. It should be understood that in the present embodiment, the second positional relationship can be any positional relationship but the one in which the first end surface is coincident with the second end surface.

In the present embodiment, the first end surface of the movable portion and the second end surface of the main body are always in parallel to each other, i.e., the movable portion is rotated with respect to the main body. The resulting rotation plane is parallel to the second end surface of the main body.

The movable portion has an image capture unit. The image capture unit may be a camera provided at a position shown in FIG. 1 or 2. The image capture unit 14 in FIG. 1 and the image capture unit 24 in FIG. 2 are located on one side of the movable portion. It should be understood that only one implementation structure is provided in the present embodiment, and the image capture unit may alternatively be arranged in the middle or on the other side of the movable portion.

Thus, with the above solution, the electronic device has a main body and a movable portion whose a positional relationship can be changed. The movable portion of the electronic device also has a communication antenna unit. Thereby, with the change in the positional relationship between the movable portion and the main body, the direction of the first communication antenna unit in the movable portion can be changed, so that the strength of the signal received by the communication antenna unit can be adjusted, thereby improving the user experience.

Third Embodiment

The embodiment of the present disclosure provides an electronic device. As shown in FIG. 1, the electronic device comprises a main body 11, a movable portion 12, and a connector 13.

A positional relationship between the main body 11 and the movable portion 12 is changeable via the connector 13.

The main body 11 comprises a first surface 111 having a display unit. The movable portion 12 comprises a second surface 121 having a long side adaptive to a short side of the first surface 111. For example, the long side of the second surface 121 has a length same as the short side of the first surface 111. The movable portion 12 has a first communication antenna unit 122.

Further, as shown in FIG. 1, when the movable portion 12 and the main body 11 are in a first positional relationship, both the first surface 111 and the second surface 121 are in a first plane. In this case, a first end surface 123 of the movable portion 12 is parallel to a second end surface 112 of the main body 11, and an overlapped area between the first end surface 123 and the second end surface 112 reaches the maximum overlapped area. It can be seen from FIG. 1 that, when the main body and the movable portion are in the first positional relationship, the overlapped area therebetween is equal to an area of the first end surface or the second end surface. In addition, the first end surface 123 and the second end surface 112 may have the same size.

While FIG. 1 shows that a distance between the first end surface 123 and the second end surface 112 is relatively large, in practice the distance therebetween is sustainably equal to 0, and almost no gap can be seen from the first plane.

As shown in FIG. 2, when the positional relationship between the movable portion 22 and the main body 21 is changed via the connector 23 to a second positional relationship, a first end surface 221 of the movable portion 22 is parallel to a second end surface 211 of the main body 21, and an overlapped area between the first end surface 221 of the movable portion 22 and the second end surface 211 of the main body 21 is smaller than the maximum overlapped area. It should be understood that in the present embodiment, the second positional relationship can be any positional relationship but the one in which the first end surface is coincident with the second end surface.

In the present embodiment, the first end surface of the movable portion and the second end surface of the main body are always in parallel to each other, i.e., the movable portion is rotated with respect to the main body. The resulting rotation plane is parallel to the second end surface of the main body.

Figure 3:
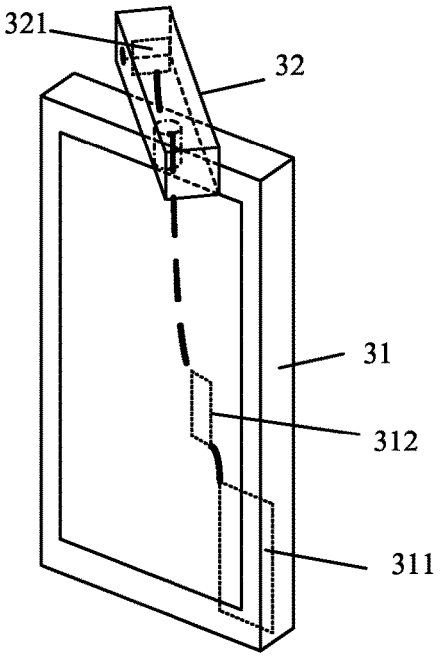
FIG. 3 is a diagram of a connection between a first communication antenna unit and a second communication antenna unit in an electronic device according to an embodiment of the present disclosure.

Preferably, as shown in FIG. 3, the main body 31 has a second communication antenna unit 311 and a radio frequency unit 312. The second communication antenna unit 311 is electrically connected to the radio frequency unit 312. The first communication antenna unit 321 is electrically connected to the radio frequency unit 312. The second communication antenna unit and the first communication antenna unit are of a same type.

In the present embodiment, the second communication antenna unit and the first communication antenna unit are two parts of a single type of antenna. For example, the second communication antenna unit can be a main antenna, and the first communication antenna unit can be a diversity antenna associated with the main antenna. The main antenna may be primarily responsible for transmitting and receiving a radio frequency signal; and the diversity antenna is generally only responsible for receiving a signal without transmission. After receiving a radio frequency signal, the diversity antenna transmits the received radio frequency signal to the radio frequency unit. At the same time, the main antenna also receives a radio frequency signal, and transmits the received radio frequency signal to the radio frequency unit. The radio frequency unit combines the radio frequency signal transmitted from the diversity antenna and the radio frequency signal transmitted from the main antenna for subsequent processing, which will not be described in detail here.

Figure 4:
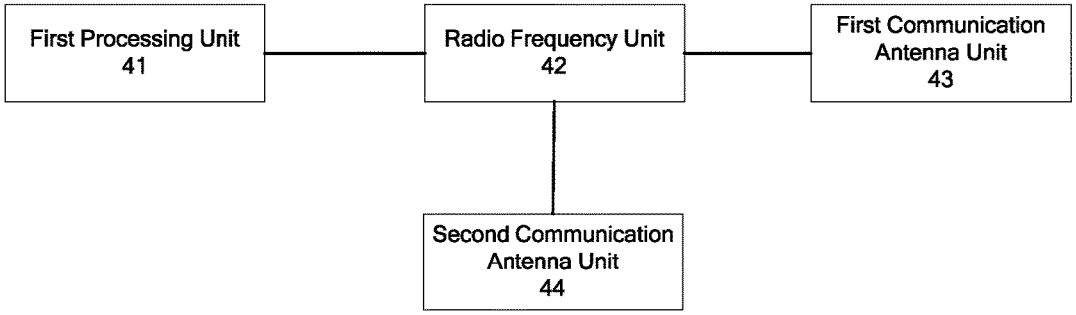
FIG. 4 is a first block diagram of an electronic device according to an embodiment of the present disclosure.

Further, the main body comprises a first processing unit. In the present embodiment, a logical connection relationship between various units in the electronic device is shown in FIG. 4. The electronic device comprises a first processing unit 41, a radio frequency unit 42, a first communication antenna unit 43, and a second communication antenna unit 44.

Specifically, the first processing unit 41 is configured to determine whether a strength of a communication signal received by the radio frequency unit from the first communication antenna unit is lower than a first preset threshold value; and if the strength of the communication signal is lower than the first preset threshold value, generate first prompt information to prompt that the movable portion is to be adjusted such that the strength of the communication signal from the first communication antenna unit is not lower than the first preset threshold value.

Correspondingly, the radio frequency unit 42 is configured to acquire the communication signal from the first communication antenna unit 43.

The first preset threshold value may be a threshold value which is set according to practical conditions.

The operation of generating the first prompt information may comprise generating the first prompt information and displaying the first prompt information on a display unit. The contents of the first prompt information may specifically comprise the strength of the communication signal acquired by the first communication antenna unit. Further, the operation of prompting that the movable portion is to be adjusted via the first prompt information may comprise adjusting the movable portion by a user with reference to the strength of the communication signal displayed on the display unit. Once the strength of the communication signal is not lower than the first preset threshold value, an indication that the strength of the communication signal from the first communication antenna unit meets a predefined condition, or an indication for prompting the user that the signal is in a good condition, can be displayed on the display unit, such that the user can completes the adjustment of the antenna. In this way, the movable portion can be adjusted by the user with reference to the strength of the communication signal from the first communication antenna unit, so that the first communication antenna unit can acquire a good communication signal.

Figure 5:
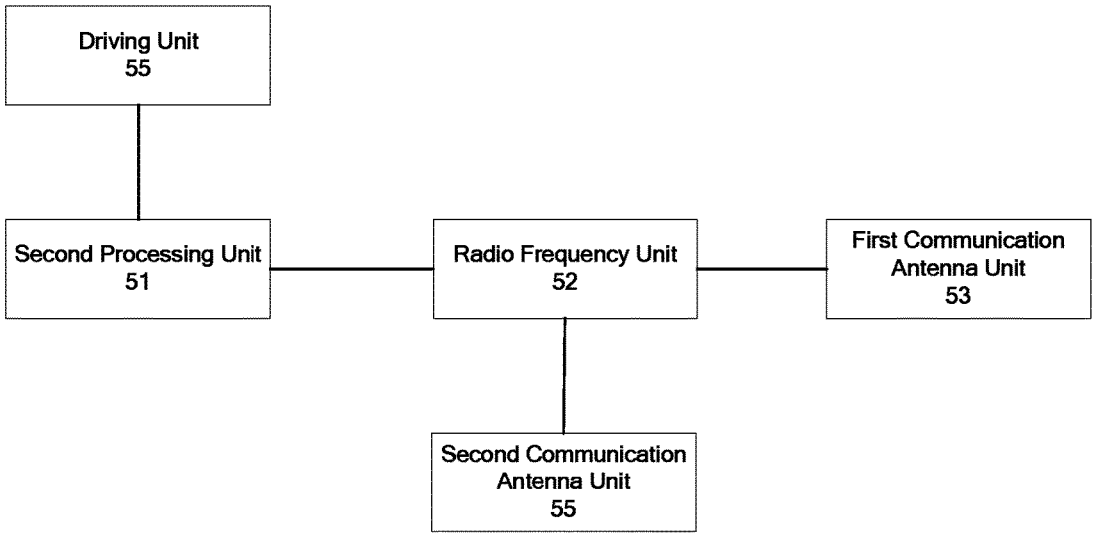
FIG. 5 is a second block diagram of an electronic device according to an embodiment of the present disclosure.

Further, the electronic device may further comprise a second processing unit. In the present embodiment, a logical connection relationship between various units in the electronic device is shown in FIG. 5. The electronic device comprises a second processing unit 51, a radio frequency unit 52, a first communication antenna unit 53, a second communication antenna unit 54, and a driving unit 55. The driving unit may be arranged in the connector.

Specifically, the second processing unit 51 is arranged in the main body and is configured to determine whether a strength of a communication signal received by the radio frequency unit from the first communication antenna unit is lower than a second preset threshold value; and if the strength of the signal is lower than the second preset threshold value, generate a first control instruction for controlling the driving unit to drive the movable portion to rotate by a first predetermined angle via the connector, such that the strength of the communication signal from the first communication antenna unit is not lower than the second preset threshold value.

The driving unit 55 is configured to control the connector to rotate according to the instruction from the second processing unit.

The second preset threshold value may be a threshold value which is set according to practical conditions.

Before generating the first control instruction, the method can further include a step of acquiring a first predetermined angle, which is for example a preset angle. As an example, it can be preset that the movable portion is rotated in units of 5 degrees. Thus, the step of controlling the driving unit to drive the movable portion to rotate by the first predetermined angle via the connector such that the strength of the communication signal from the first communication antenna unit is not lower than the second preset threshold value may comprise adjusting the movable portion by the first predetermined angle for a number of times, until the strength of the communication signal from the first communication antenna unit is not lower than the second preset threshold value.

The driving unit may be an electrical component installed on the connector to electrically drive the connector to rotate.

The movable portion has an image capture unit. The image capture unit may be a camera provided at a position shown in FIG. 1 or 2. The image capture unit 14 in FIG. 1 and the image capture unit 24 in FIG. 2 are located on one side of the movable portion. It should be understood that only one implementation structure is provided in the present embodiment, and the image capture unit may alternatively be arranged in the middle or on the other side of the movable portion.

Thus, with the above solution, the electronic device has a main body and a movable portion whose a positional relationship can be changed. The movable portion of the electronic device also has a communication antenna unit. Thereby, with the change in the positional relationship between the movable portion and the main body, the direction of the first communication antenna unit in the movable portion can be changed, so that the strength of the signal received by the communication antenna unit can be adjusted, thereby improving the user experience.

Fourth Embodiment

The embodiment of the present disclosure provides an electronic device. As shown in FIG. 1, the electronic device comprises a main body 11, a movable portion 12, and a connector 13.

A positional relationship between the main body 11 and the movable portion 12 is changeable via the connector 13.

The main body 11 comprises a first surface 111 having a display unit. The movable portion 12 comprises a second surface 121 having a long side adaptive to a short side of the first surface 111, for example, the long side of the second surface 121 has a length same as the short side of the first surface 111. The movable portion 12 has a first communication antenna unit 122.

Further, as shown in FIG. 1, when the movable portion 12 and the main body 11 are in a first positional relationship, both the first surface 111 and the second surface 121 are in a first plane. In this case, a first end surface 123 of the movable portion 12 is parallel to a second end surface 112 of the main body 11, and an overlapped area between the first end surface 123 and the second end surface 112 reaches the maximum overlapped area. It can be seen from FIG. 1 that, when the main body and the movable portion are in the first positional relationship, the overlapped area therebetween is equal to an area of the first end surface or the second end surface. In addition, the first end surface 123 and the second end surface 112 may have the same size.

While FIG. 1 shows that a distance between the first end surface 123 and the second end surface 112 is relatively large, in practice the distance therebetween is sustainably equal to 0, and almost no gap can be seen from the first plane.

As shown in FIG. 2, when the positional relationship between the movable portion 22 and the main body 21 is changed via the connector 23 to a second positional relationship, a first end surface 221 of the movable portion 22 is parallel to a second end surface 211 of the main body 21, and an overlapped area between the first end surface 221 of the movable portion 22 and the second end surface 211 of the main body 21 is smaller than the maximum overlapped area. It should be understood that in the present embodiment, the second positional relationship can be any positional relationship but the one in which the first end surface is coincident with the second end surface.

In the present embodiment, the first end surface of the movable portion and the second end surface of the main body are always in parallel to each other, i.e., the movable portion is rotated with respect to the main body. The resulting rotation plane is parallel to the second end surface of the main body.

Preferably, the first communication antenna unit can comprise N communication sub-units. The main body has a third processing unit. The third processing unit comprises N processing sub-units for the N communication sub-units, N being a positive integer greater than or equal to 1.

The N communication sub-units may be different types of communication units, e.g., WIFI antennas, Bluetooth antennas, GPS antennas or the like.

Figure 6:
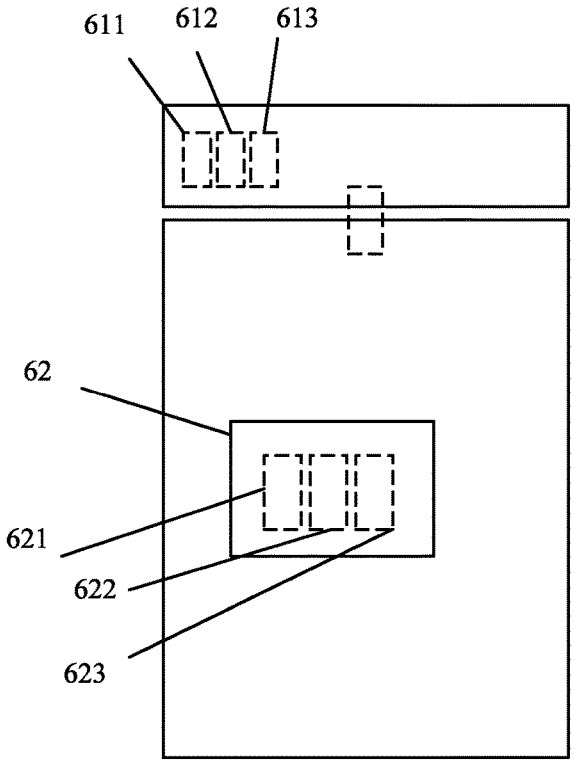
FIG. 6 is a structural diagram of a first communication antenna unit consisting of multiple communication sub-units according to an embodiment of the present disclosure.

For example, as shown in FIG. 6, the present embodiment will be described with reference to an example where N is equal to 3. The first communication antenna unit comprises a communication sub-unit 611, a communication sub-unit 612, and a communication sub-unit 613. Correspondingly, the third processing unit 62 comprises a processing sub-unit 621, a processing sub-unit 622, and a processing sub-unit 623.

Preferably, the third processing unit is configured to select a first communication sub-unit from the N communication sub-units, determine whether a strength of a signal from the first communication sub-unit is lower than a third preset threshold value, and if the strength of the signal from the first communication sub-unit is lower than the third preset threshold value, generate a second control instruction for controlling the driving unit to drive the movable portion to rotate by a second predetermined angle via the connector, such that the strength of the signal from the communication sub-unit is not lower than the third preset threshold value.

The third preset threshold value may be a threshold value which is differently set according to the communication sub-unit. The second predetermined angle may be an angle which is preset according to practical conditions. For example, the second predetermined angle may be preset as 10 degrees. That is, after the movable portion is rotated by 10 degrees, it is determined whether the strength of the signal from the corresponding communication sub-unit is not lower than the corresponding preset threshold value, and if the strength is still lower than the preset threshold value, the movable portion is continued to be rotated by the second predetermined angle, until the strength of the signal from the communication sub-unit is not lower than the corresponding third preset threshold value.

Preferably, the first communication sub-unit may be selected in any of the following manners.

In a first manner, the first communication sub-unit is selected randomly. For example, each of the communication sub-units may be selected periodically.

In a second manner, a currently activated application is acquired, and a communication sub-unit used by the application is selected as the first communication sub-unit.

The movable portion has an image capture unit. The image capture unit may be a camera provided at a position shown in FIG. 1 or 2. The image capture unit 14 in FIG. 1 and the image capture unit 24 in FIG. 2 are located on one side of the movable portion. It should be understood that only one implementation structure is provided in the present embodiment, and the image capture unit may alternatively be arranged in the middle or on the other side of the movable portion.

Thus, with the above solution, the electronic device has a main body and a movable portion whose a positional relationship can be changed. The movable portion of the electronic device also has a communication antenna unit. Thereby, with the change in the positional relationship between the movable portion and the main body, the direction of the first communication antenna unit in the movable portion can be changed, so that the strength of the signal received by the communication antenna unit can be adjusted, thereby improving the user experience.

Fifth Embodiment

The embodiment of the present disclosure provides an electronic device. As shown in FIG. 1, the electronic device comprises a main body 11, a movable portion 12, and a connector 13.

A positional relationship between the main body 11 and the movable portion 12 is changeable via the connector 13.

The main body 11 comprises a first surface 111 having a display unit. The movable portion 12 comprises a second surface 121 having a long side adaptive to a short side of the first surface 111. For example, the long side of the second surface 121 has a length same as the short side of the first surface 111. The movable portion 12 has a first communication antenna unit 122.

Further, as shown in FIG. 1, when the movable portion 12 and the main body 11 are in a first positional relationship, both the first surface 111 and the second surface 121 are in a first plane. In this case, a first end surface 123 of the movable portion 12 is parallel to a second end surface 112 of the main body 11, and an overlapped area between the first end surface 123 and the second end surface 112 reaches the maximum overlapped area. It can be seen from FIG. 1 that, when the main body and the movable portion are in the first positional relationship, the overlapped area therebetween is equal to an area of the first end surface or the second end surface. In addition, the first end surface 123 and the second end surface 112 may have the same size.

While FIG. 1 shows that a distance between the first end surface 123 and the second end surface 112 is relatively large, in practice the distance therebetween is sustainably equal to 0, and almost no gap can be seen from the first plane.

As shown in FIG. 2, when the positional relationship between the movable portion 22 and the main body 21 is changed via the connector 23 to a second positional relationship, a first end surface 221 of the movable portion 22 is parallel to a second end surface 211 of the main body 21, and an overlapped area between the first end surface 221 of the movable portion 22 and the second end surface 211 of the main body 21 is smaller than the maximum overlapped area. It should be understood that in the present embodiment, the second positional relationship can be any positional relationship but the one in which the first end surface is coincident with the second end surface.

In the present embodiment, the first end surface of the movable portion and the second end surface of the main body are always in parallel to each other, i.e., the movable portion is rotated with respect to the main body. The resulting rotation plane is parallel to the second end surface of the main body.

Preferably, the first communication antenna unit can comprise a first type of communication antenna unit and a second type of communication antenna unit. The second type of communication antenna unit comprises M communication antenna sub-units, M being a positive integer greater than or equal to 1. The main body has a radio frequency unit and a second communication antenna unit corresponding to the first type of communication antenna unit. The type of the first type of communication antenna unit is the same as that of the second communication antenna unit.

Figure 7:
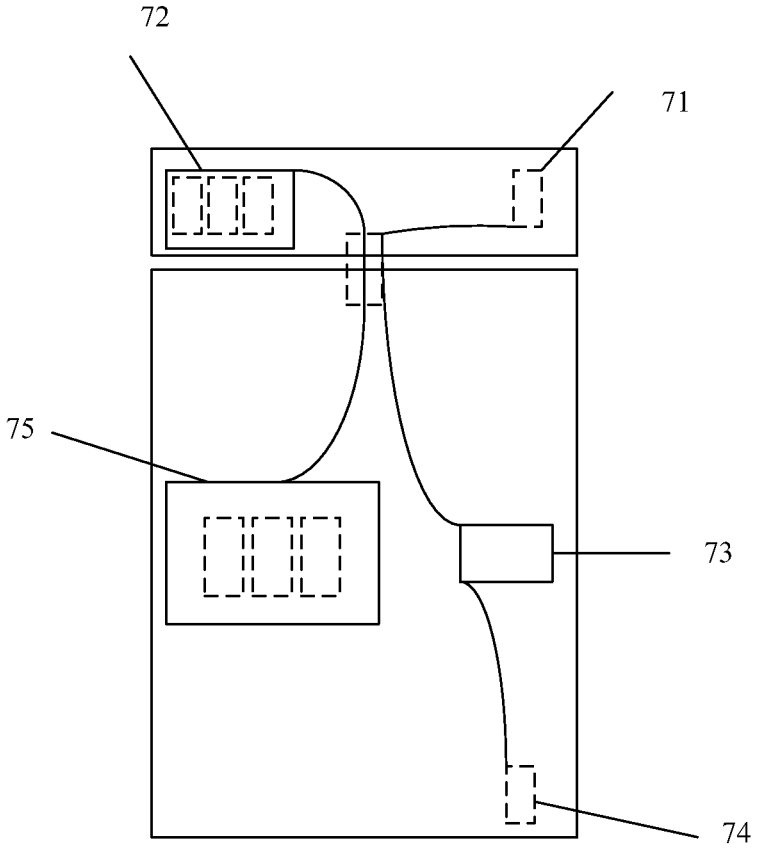
FIG. 7 is a structural diagram of a first communication antenna unit consisting of multiple types of communication units according to an embodiment of the present disclosure.

For example, as shown in FIG. 7, the electronic device includes a first type of communication antenna unit 71, second communication antenna sub-units 72, a radio frequency unit 73, a second communication antenna unit 74, and a fourth processing unit 75 for the M second communication antenna sub-units.

The electronic device further comprises a fourth processing unit 75 configured to acquire a type of a signal used by a first application, determine a corresponding communication unit according to the type of the signal; acquire a strength of the signal corresponding to the communication unit by using a detection unit; determine whether the strength of the signal corresponding to the communication unit is lower than a preset threshold value, and if the strength of the signal corresponding to the communication unit is lower than the preset threshold value, generate a third control instruction for controlling the driving unit to drive the movable portion to rotate by a third predetermined angle via the connector, such that the strength of the signal from the communication unit is not lower than the preset threshold value.

The first application is an application running in foreground, and the first communication sub-unit is a communication antenna unit in the first communication antenna unit.

The M communication sub-units may be different types of communication units, e.g., a WIFI antenna, a Bluetooth antenna, a GPS antenna or the like.

The movable portion has an image capture unit. The image capture unit may be a camera provided at a position shown in FIG. 1 or 2. The image capture unit 14 in FIG. 1 and the image capture unit 24 in FIG. 2 are located on one side of the movable portion. It should be understood that only one implementation structure is provided in the present embodiment, and the image capture unit may alternatively be arranged in the middle or on the other side of the movable portion.

Thus, with the above solution, the electronic device has a main body and a movable portion whose a positional relationship can be changed. The movable portion of the electronic device also has a communication antenna unit. Thereby, with the change in the positional relationship between the movable portion and the main body, the direction of the first communication antenna unit in the movable portion can be changed, so that the strength of the signal received by the communication antenna unit can be adjusted, thereby improving the user experience.

It should be understood that the devices disclosed in the embodiments of the present disclosure may be implemented in other manners. The device embodiments as described above are merely illustrative. For example, the division of the units is merely a logically functional division, and in practice, there may be other division manners. For example, multiple units or components may be combined, or some features may be ignored. In addition, various constituent parts, which are displayed or discussed as being coupled or communicatively connected directly, may also be coupled or communicatively connected indirectly via some interfaces, devices or units in an electrical manner, a mechanical manner, or other manners.

The above units described as separate components may be or may not be separated physically. The components displayed as units may be or may not be physical units, i.e., they may be located in a place or may also be distributed over multiple network units. A part or all of the units may be selected as desired to achieve the object of the solutions of the present disclosure.

The above description is merely specific embodiments of the present disclosure, and the scope of the present disclosure is not limited thereto. Changes or substitutions, which can be contemplated by those skilled persons in the art, should be included in the scope of the present disclosure without departing the scope defined by the appended claims. The scope of the present disclosure should be defined by the claims only.

The invention claimed is:

1. An electronic device comprising a main body, a movable portion, and a connector, wherein a positional relationship between the main body and the movable portion is changeable via the connector;

the main body comprises a first surface having a display unit, the movable portion comprises a second surface having a long side adaptive to a short side of the first surface;

the movable portion has a first communication antenna unit;

when the movable portion and the main body are in a first positional relationship, both the first surface and the second surface are in a first plane; and when the positional relationship between the movable portion and the main body is changed via the connector to a second positional relationship, a first end surface of the movable portion is parallel to a second end surface of the main body, and an overlapped area between the first end surface of the movable portion and the second end surface of the main body is smaller than a maximum overlapped area.

2. The electronic device according to claim 1, wherein the long side of the second surface has a length equal to the short side of the first surface.

3. The electronic device according to claim 1, wherein, the movable portion comprises an image capture unit.

4. An electronic device comprising a main body, a movable portion, and a connector, wherein a positional relationship between the main body and the movable portion is changeable via the connector:

the main body comprises a first surface having a display unit the movable portion comprises a second surface having a long side adaptive to a short side of the first surface;

the movable portion has a first communication antenna unit;

the main body further comprises a second communication antenna unit and a radio frequency unit;

the first and second communication antenna units are electrically connected to the radio frequency unit; and the second communication antenna unit and the first communication antenna unit are of a same type.

5. The electronic device according to claim 4, further comprising:

a first processing unit arranged in the main body, wherein the first processing unit is configured to:

determine whether a strength of a communication signal received by the radio frequency unit from the first communication antenna unit is lower than a first preset threshold value; and if the strength of the communication signal is lower than the first preset threshold value, generate first prompt information to prompt that the movable portion is to be adjusted such that the strength of the communication signal from the first communication antenna unit is not lower than the first preset threshold value;

wherein the radio frequency unit is configured to acquire the communication signal from the first communication antenna unit.

6. The electronic device according to claim 4, further comprising:

a second processing unit arranged in the main body and configured to determine whether a strength of a communication signal received by the radio frequency unit from the first communication antenna unit is lower than a second preset threshold value; if the strength of the signal is lower than the second preset threshold value, generate a first control instruction for controlling a driving unit to drive the movable portion to rotate by a first predetermined angle via the connector, such that the strength of the communication signal from the first communication antenna unit is not lower than the second preset threshold value; and the driving unit configured to control the connect to rotate according to the instruction from the second processing unit.

7. An electronic device comprising a main body, a movable portion, and a connector, wherein a positional relationship between the main body and the movable portion is changeable via the connector;

the main body comprises a first surface having a display unit, the movable portion comprises a second surface laving a long side adaptive to a short side of the first surface;

the movable portion has a first communication antenna unit;

the first communication antenna unit comprises N communication sub-units; and the main body comprises a third processing unit, wherein the third processing unit comprises N processing sub-units corresponding to the N communication sub-units, N being a positive integer greater than or equal to 1.

8. The electronic device according to claim 7, wherein the third processing unit is configured to:

select a first communication sub-unit from the N communication sub-units;

determine whether a strength of a signal from the first communication sub-unit is lower than a third preset threshold value; and if the strength of the signal is lower than the third preset threshold value, generate a second control instruction for controlling the driving unit to drive the movable portion to rotate by a second predetermined angle via the connector, such that the strength of the signal from the communication sub-unit is not lower than the third preset threshold value.

9. An electronic device comprising a main body, a movable portion, and a connector, wherein a positional relationship between the main body and the movable portion is changeable via the connector;

the main body comprises a first surface having a display unit, the movable portion comprises a second surface having a long side adaptive to a short side of the first surface;

the movable portion has a first communication antenna unit;

the first communication antenna unit comprises a first type of communication antenna unit and a second type of communication antenna unit, wherein the second type of communication antenna unit comprises M communication antenna sub-units, M being a positive integer greater than or equal to 1; and the main body comprises a radio frequency unit and a second communication antenna unit corresponding to the first type of communication antenna unit, wherein a type of the first type of communication antenna unit is the same as that of the second communication antenna unit.

10. The electronic device according to claim 9, further comprising a fourth processing unit configured to:

acquire a type of a signal used by a first application, the first application being an application running in foreground;

determine a corresponding communication unit according to the type of the signal;

acquire a strength of the signal corresponding to the communication unit by using a detection unit;

determine whether the strength of the signal corresponding to the communication unit is lower than a preset threshold value; and if the strength of the signal corresponding to the communication unit is lower than the preset threshold value, generate a third control instruction for controlling the driving unit to drive the movable portion to rotate by a third predetermined angle via the connector, such that the strength of the signal from the communication unit is not lower than the preset threshold value.

* * * * *